US006694529B1

(12) United States Patent
Chiu

(10) Patent No.: US 6,694,529 B1
(45) Date of Patent: Feb. 24, 2004

(54) HELMET STRUCTURE

(76) Inventor: Tzu Tao Chiu, No. 19, Lane 17, Yung Chi St., Ying Ko Jen, Taipei Hsien (TW)

( * ) Notice: Subject to any disclaimer, the term of this patent is extended or adjusted under 35 U.S.C. 154(b) by 0 days.

(21) Appl. No.: 10/302,888

(22) Filed: Nov. 25, 2002

(51) Int. Cl.[7] ..... A42B 3/00
(52) U.S. Cl. ..... 2/411; 2/414; 2/417
(58) Field of Search ..... 2/411, 412, 414, 2/416, 417, 420

(56) References Cited

U.S. PATENT DOCUMENTS 3,500,473 A * 3/1970 Marchello ..... 2/414
4,286,339 A * 9/1981 Coombs ..... 2/414
5,271,103 A * 12/1993 Darnell ..... 2/418

FOREIGN PATENT DOCUMENTS

GB 2202729 A * 10/1988 ..... A42B/3/00

* cited by examiner

*Primary Examiner*—Rodney M. Lindsey
(74) *Attorney, Agent, or Firm*—Rosenberg, Klein & Lee

(57) ABSTRACT

A helmet structure includes a cap body and a setoff element. A plurality of slots is distributed on an interior surface of the cap body. A rubber strip fills each of the slots. The protruding ribs are distributed on an external surface of the setoff element in a manner to match respectively with the slots of the cap body. Since the soft rubber has a high frictional contact, the U-shaped rubber strips not only fit the slots but also tightly attaches to the protruding ribs. Therefore, the cap body is firmly attached the setoff element. However, when the helmet is to be cleaned; the setoff element and the cap body are easily dismounted by pulling the protruding ribs out of the slots without the need of any tool.

8 Claims, 5 Drawing Sheets

HELMET STRUCTURE

BACKGROUND OF THE INVENTION

1. Field of the Invention

The invention relates to a helmet structure and, more specifically, to a helmet structure that is easy to dismount and clean.

2. Description of the Related Art

In a conventional helmet, a polymer or foam is used as a lining thereof and is adhered or screwed to the helmet. A mattress protector pad can be further provided over the polymer or foam layer to improve the aesthetics and feeling thereof.

However, the mattress protector pad or the lining is easily stained with dust and color spots after long-term use. Since the mattress protector pad or the lining is secured to the helmet, it is difficult to clean completely the whole helmet. Therefore, the user has to regularly buy a new helmet if the helmet becomes too dirty.

Therefore, there is a need for an improved helmet structure that is easy to clean and more comfortable for the user's head.

SUMMARY OF THE INVENTION

It is therefore a principal object of the invention to provide a helmet structure in which the use of a high frictional contact soft rubber, associated with U-shaped rubber strips, fits the slots but also tightly attaches to the protruding ribs. Therefore, the cap body is securely attached to the setoff element. However, when the helmet is to be cleaned, the setoff element and the cap body are easily dismounted by pulling the protruding ribs out of the slots without the need of any tool.

In order to achieve the above and other objectives of the invention, a helmet structure of the invention comprises a cap body and a setoff element. A plurality of slots is distributed on an interior surface of the cap body and a rubber strip each of the slots. A plurality of protruding ribs is distributed on an external surface of the setoff element in a manner to respectively match with the slots of the cap body. A circular groove surrounds a bottom of the setoff element, and a plurality of flexible sheets is placed inside the circular groove to define a plurality of buffering spaces.

To provide a further understanding of the invention, the following detailed description illustrates embodiments and examples of the invention, this detailed description being provided only for illustration of the invention.

BRIEF DESCRIPTION OF THE DRAWINGS

The drawings included herein provide a further understanding of the invention. A brief introduction of the drawings is as follows.

DETAILED DESCRIPTION OF THE EMBODIMENTS

Figure 1:
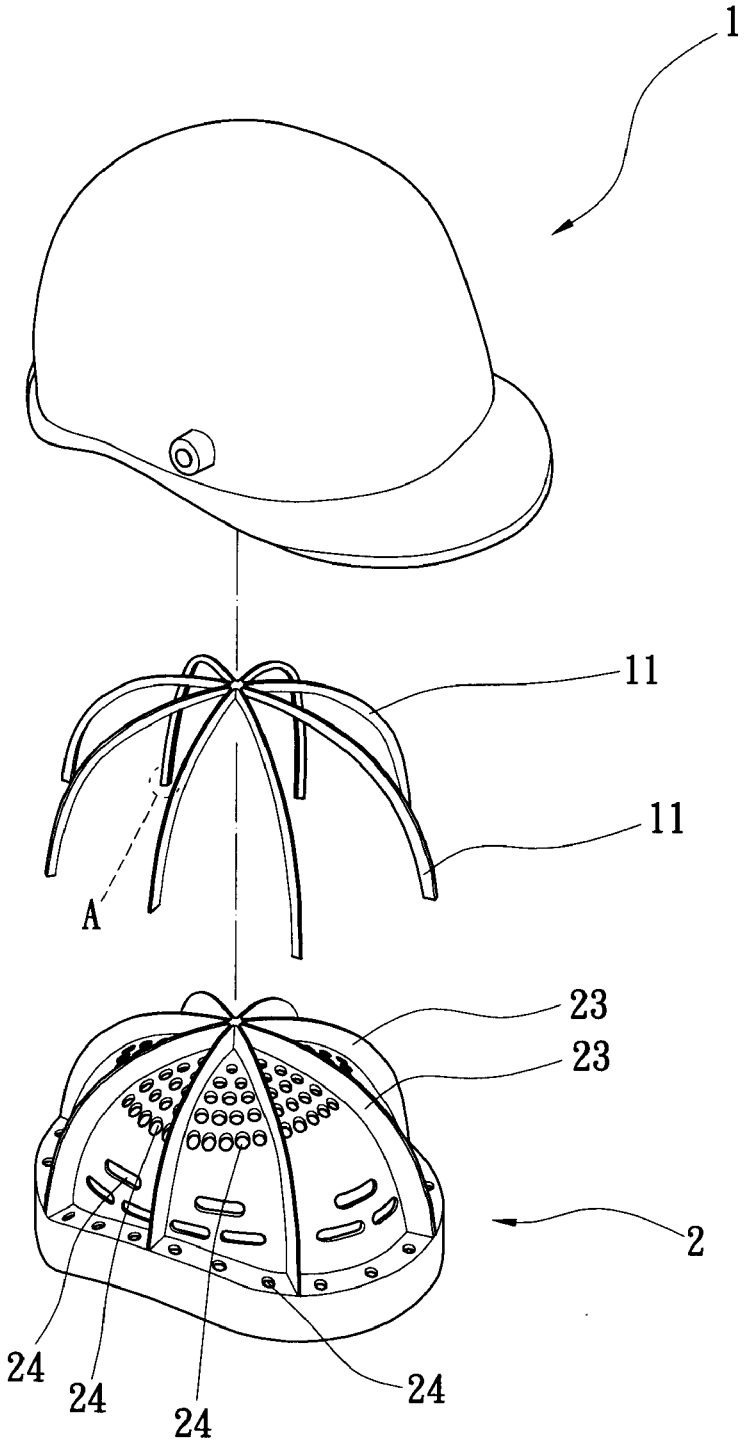
FIG. 1 is an exploded view of a helmet structure according to an embodiment of the invention.
Figure 1A:
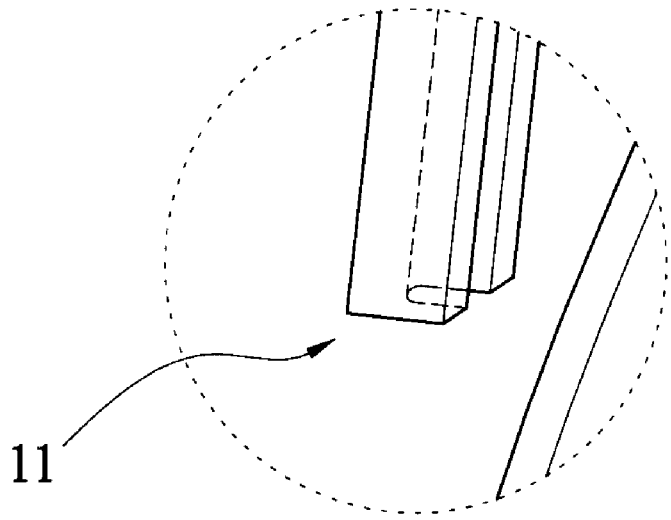
FIG. 1A is a partially enlarged view of FIG. 1.

Wherever possible in the following description, like reference numerals will refer to like elements and parts unless otherwise illustrated.

Figure 2:
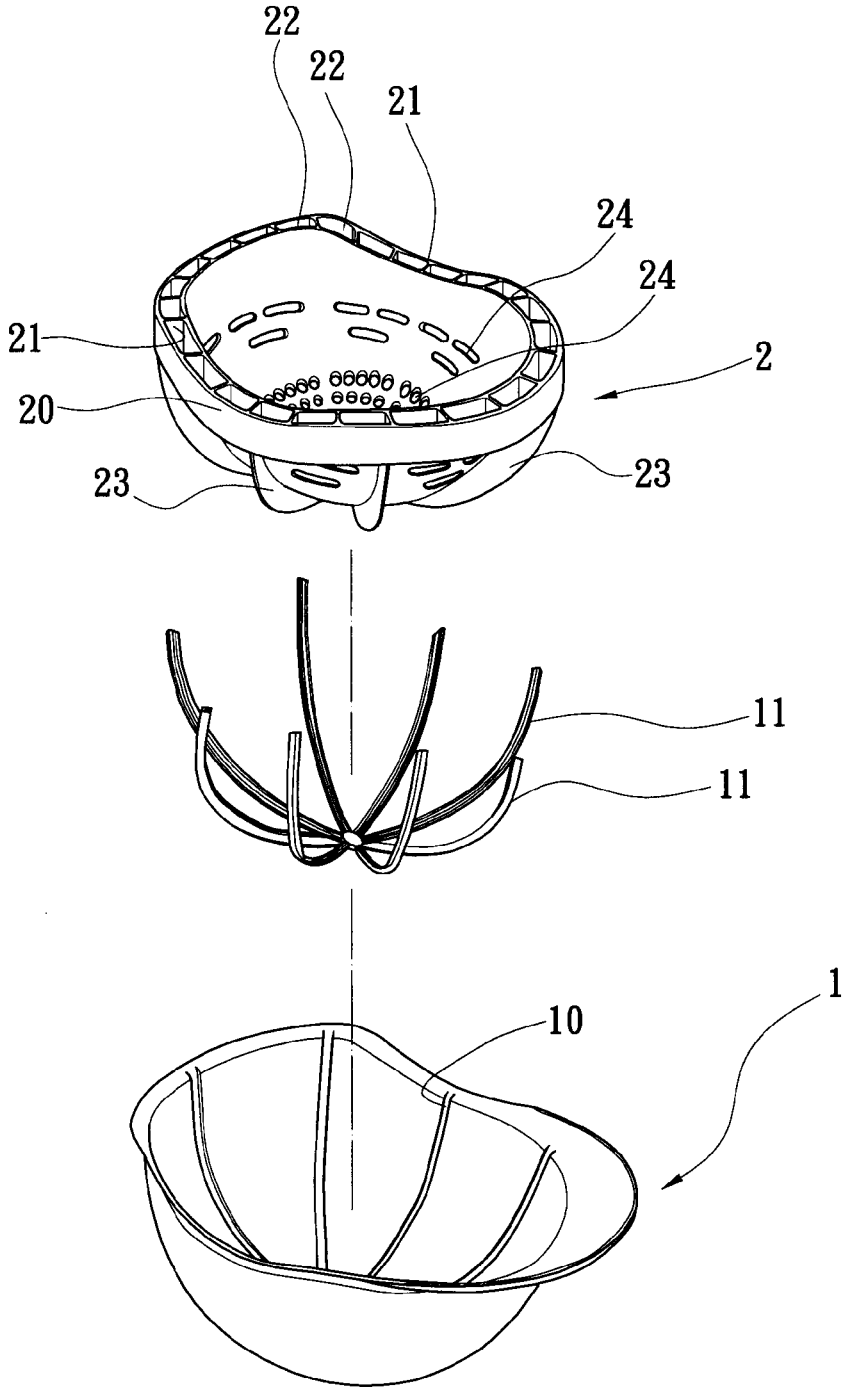
FIG. 2 is an exploded view of a helmet structure from a different view angle according to an embodiment of the invention.
Figure 3:
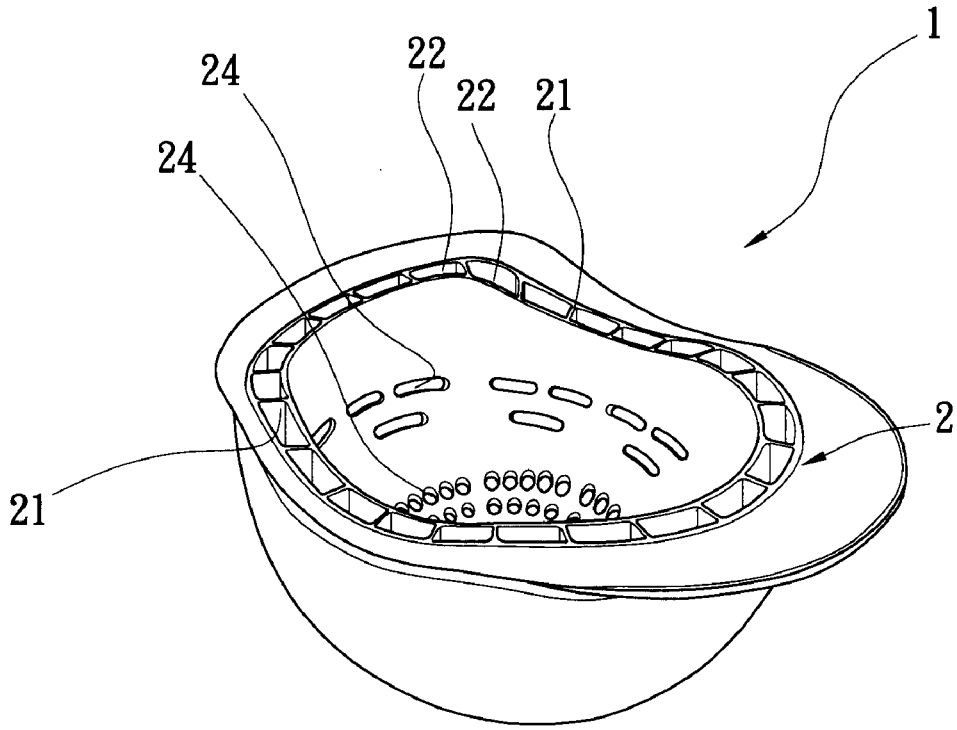
FIG. 3 is a perspective view of a helmet structure according to an embodiment of the invention.

Referring to FIG. 1 to FIG. 3, the invention provides a helmet structure including a cap body 1 and a setoff element 2. A plurality of slots 10 is distributed on an interior surface of the cap body 1 in a manner to radiate from a center of the cap body 1. An U-shaped rubber strip 11 fills each of the slots 10.

The setoff element 2 includes a circular groove 20, a plurality of flexible sheets 21, a plurality of protruding ribs 23 and a plurality of holes 24. The protruding ribs 23 are made of a hard rubber or plastic, for example. The protruding ribs 23 are distributed on an external surface of the cap body 2 in a manner to match respectively the slots 10 of the cap body 1. The protruding ribs 23 are tightly engaged with the slots 10 on which are applied the rubber strips 11. The circular groove 20 surrounds a bottom of the setoff element 2. The flexible sheets 21 are placed inside the circular groove 20, the flexible sheets 21 being spaced apart from one another to define a plurality of buffering spaces 22. The flexible sheet 21 is made of soft rubber, for example. The holes 24 are distributed on the setoff element 2. The shape of the hole 24 can be circular, oval, square, irregular, or any other shape adequate to effectively dissipate the heat from the user's head.

Figure 4:
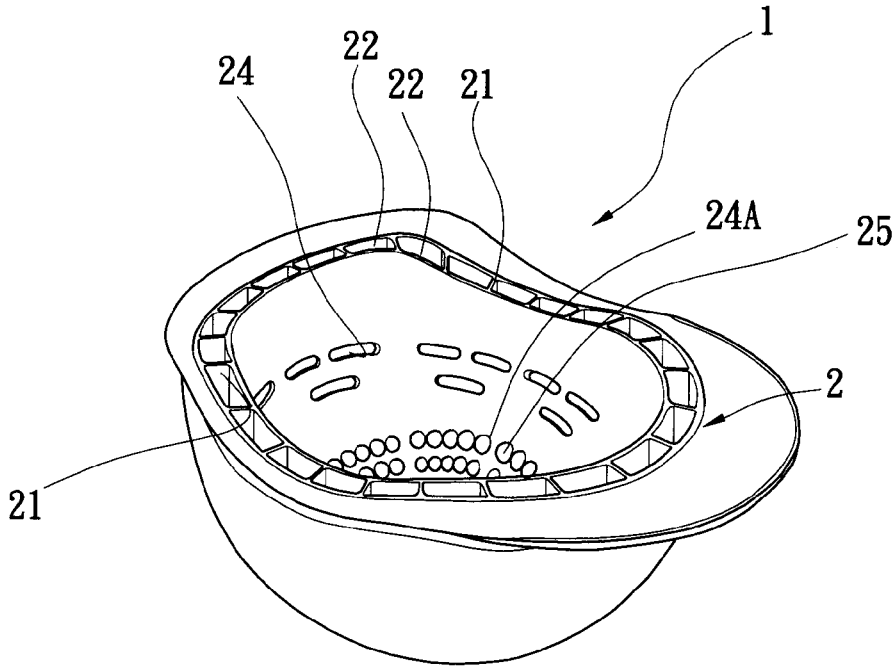
FIG. 4 is a perspective view of a helmet structure according to another embodiment of the invention.

Referring to FIG. 4, a part of the holes 24 of the setoff element 2 may be further provided with a plurality of massage bumps 25. The massage bumps 25 can be soft rubber bumps or hollow plastic bumps, which are elastic and soft. When the user body vibrates as the user, for example, is riding a motorcycle, the user's head touches the massage bumps 25, which therefore provides a massage action.

Since the soft rubber has high frictional contact, the U-shaped rubber strips 11 not only fit the slots 10 but also tightly attach to the protruding ribs 23. Therefore, the cap body 1 is securely attached to the setoff element 2. However, when the helmet is to be cleaned, the setoff element 2 and the cap body are easily dismounted by pulling the protruding ribs 23 out of the slots 10, without the need any tool such as screw driver. When the helmet is dropped or receives a shock, the flexible sheet 21 and the buffering space 22 prevent the helmet from being damaged. The helmet structure of the invention has a simplified structure that is easy to wash and more comfortable for user's head.

It should be apparent to those skilled in the art that the above description is only illustrative of specific embodiments and examples of the invention. The inventions should therefore cover various modifications and variations made to the herein-described structure and operations of the invention, provided they fall within the scope of the invention as defined in the following appended claims.

What is claimed is:

1. A helmet structure comprising:

a cap body, including a plurality of slots distributed on an interior surface of the cap body and a rubber strip filling each of the slots; and a setoff element, including a plurality of protruding ribs distributed on an external surface of the setoff element in a manner to match respectively with the slots of the cap body, a circular groove surrounding a bottom of the setoff element, and a plurality of flexible sheets placed inside the circular groove to define a plurality of buffering spaces.

2. The helmet structure of claim 1, wherein the slots are distributed in a manner to radiate from a center of the cap body.

3. The helmet structure of claim 1, wherein the protruding ribs are made of hard rubber or plastics.

4. The helmet structure of claim 1, wherein the rubber strip has an U-shape fitting each slot.

5. The helmet structure of claim 1, wherein the flexible sheet is made of soft rubber.

6. The helmet structure of claim 1, wherein a plurality of holes are distributed on the setoff element, and a shape of each hole is circular, oval, square, or irregular.

7. The helmet structure of claim 6, wherein a part of the holes of the setoff element is further provided with a plurality of massage bumps.

8. The helmet structure of claim 7, wherein the massage bumps are soft rubber bumps or hollow plastic bumps.

* * * * *